United States Patent [19]

Roof et al.

[11] Patent Number: 4,600,131

[45] Date of Patent: Jul. 15, 1986

[54] POUROUT FITMENT/CLOSURE

[75] Inventors: William M. Roof, Louisville; Dennis P. Blair, Prospect, both of Ky.

[73] Assignee: Thoroughbred Plastics Corp., Louisville, Ky.

[21] Appl. No.: 556,754

[22] Filed: Nov. 30, 1983

[51] Int. Cl.[4] ..... C65D 25/40

[52] U.S. Cl. ..... 222/478; 222/547; 222/562

[58] Field of Search ..... 222/109, 478, 479, 488, 222/547, 564, 566, 567, 570

[56] References Cited

U.S. PATENT DOCUMENTS

| | | | |
|---|---|---|---|
| 2,630,944 | 3/1953 | Wheaton | 222/564 X |
| 3,091,373 | 5/1963 | Kirschenbaum | 222/479 X |
| 3,319,842 | 5/1967 | Miller | 222/479 |
| 3,762,612 | 10/1973 | Miller | 222/479 |
| 3,980,211 | 9/1976 | Owens | 222/547 X |
| 4,128,189 | 12/1978 | Baxter | 222/109 |
| 4,187,964 | 2/1980 | Bogart | 222/547 X |
| 4,494,682 | 1/1985 | Beckstrom et al. | 222/570 X |

*Primary Examiner*—Joseph J. Rolla
*Assistant Examiner*—Frederick R. Handren
*Attorney, Agent, or Firm*—Kline, Rommel & Colbert

[57] ABSTRACT

A pourout fitment/closure that may be applied as a single unit to a container for liquids, includes a plurality of areas providing a liquid tight seal as torqued onto a container, and wherein, on removal of the closure, the fitment regulates and provides a smooth rate of flow of liquid as it is dispensed therethrough from the container.

57 Claims, 6 Drawing Figures

FIG. 2
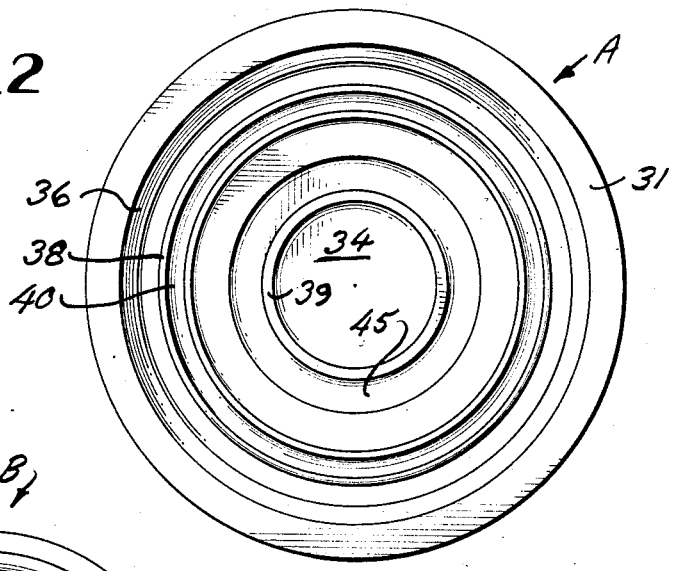
FIG. 4
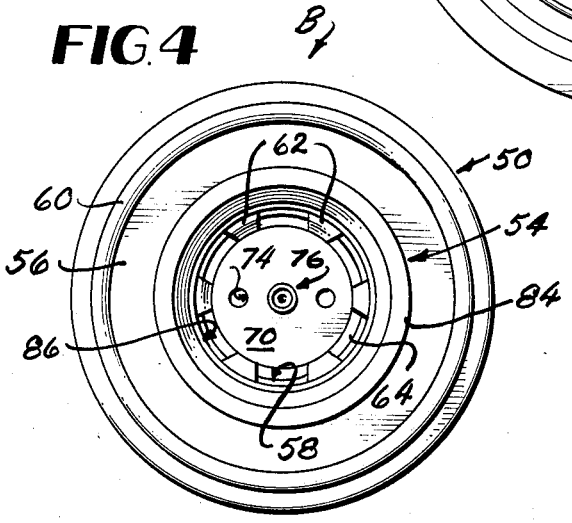
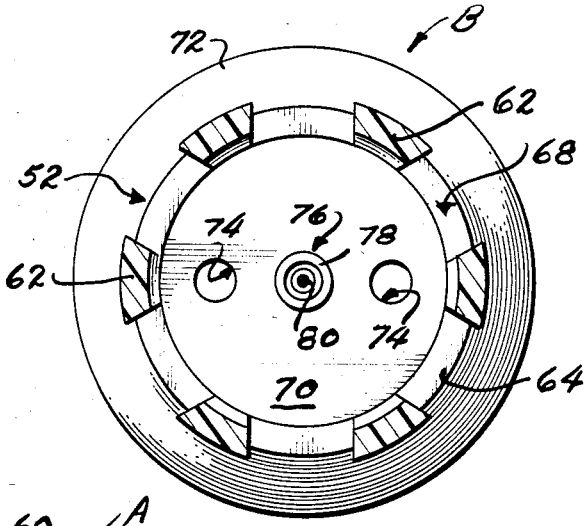
FIG. 5
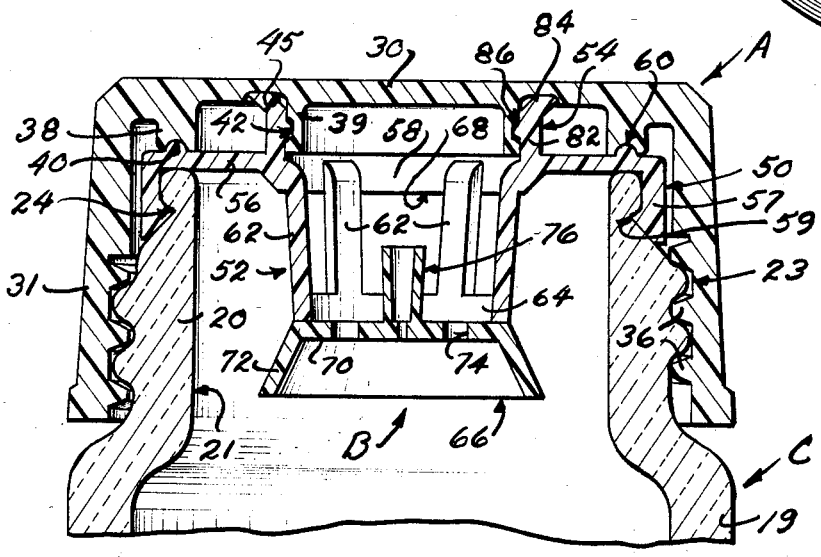
FIG. 6

POUROUT FITMENT/CLOSURE

BRIEF BACKGROUND, FIELD AND OBJECTIVES OF THE INVENTION

This invention relates to improvements in a pourout fitment/closure for use on containers for liquids.

The invention has been primarily developed for use in connection with bottles for alcoholic beverages, particularly relatively large 1.75 liter bottles. In pouring liquid from such bottles, in the absence of a suitable pouring device, it is difficult to control the rate of flow of the liquid being dispensed, without splashing, spurting, dripping, or other spillage.

We are aware that others have previously proposed use of various types of fitment-closure combinations. For instance, as shown in U.S. Pat. Nos. 2,975,947; 3,297,211; 3,311,275; 3,330,450; 3,361,307; 3,563,422; and 3,980,211. All of these patents provide a fitment depending within the bottle neck, recognize that the particular configuration of the fitment determines regulation of liquid flow, and are concerned with providing proper sealing relationship.

It is a primary object of this invention to provide a pourout fitment/closure for use on containers for liquids and in which the fitment includes a generally cylindrical hub portion depending to within the discharge opening of the neck of a liquid container and which has an interacting structural configuration to regulate the liquid rate and manner of flow to minimize splashing and spurting of the liquid being dispensed.

A further object is the provision of a pourout fitment/closure having an improved sealing construction.

A still further object is the provision of a pourout fitment/closure that can be applied to a liquid container as one unit in a single manufacturing step.

Other objects and advantages of the invention will become apparent from the following detailed description taken in connection with the accompanying drawings, and in which drawings:

BRIEF DESCRIPTION OF THE DRAWINGS

FIG. 2 is a bottom plan view of the closure of FIG. 1.

FIG. 4 is a top view of the closure of FIG. 3.

FIG. 5 is a transverse sectional view as taken substantially on the line 5—5 of FIG. 3.

FIG. 6 is a vertical sectional view showing our improved pourout fitment/closure attached to a container.

DETAILED DESCRIPTION

Figure 1:
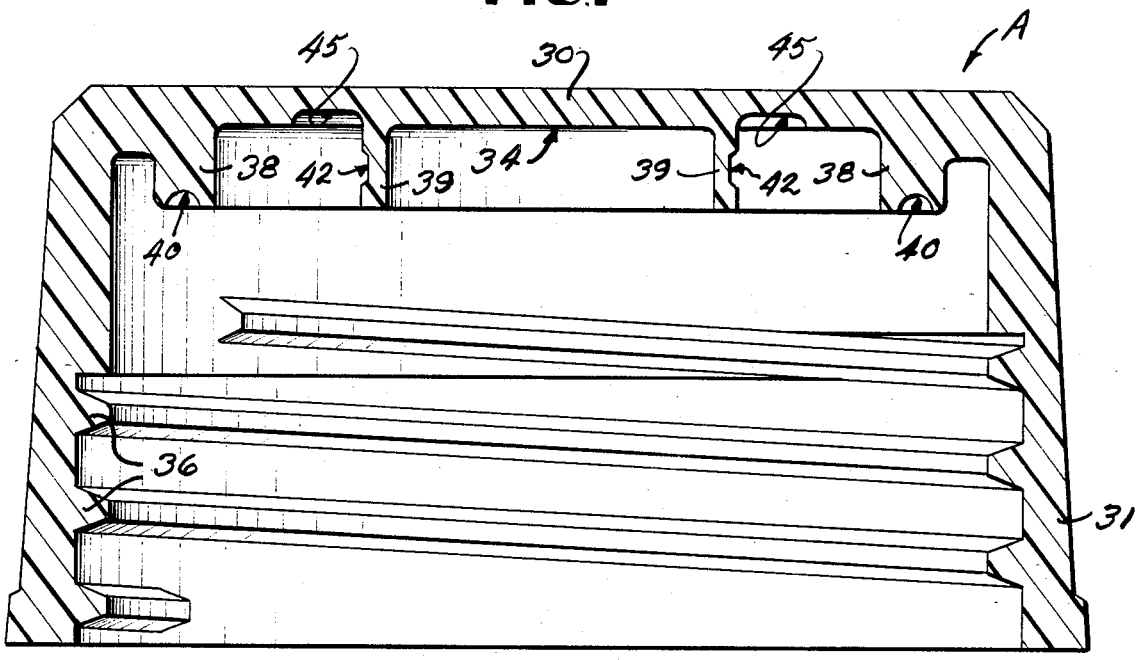
FIG. 1 is a vertical sectional view of the closure of our improved pourout fitment/closure.
Figure 3:
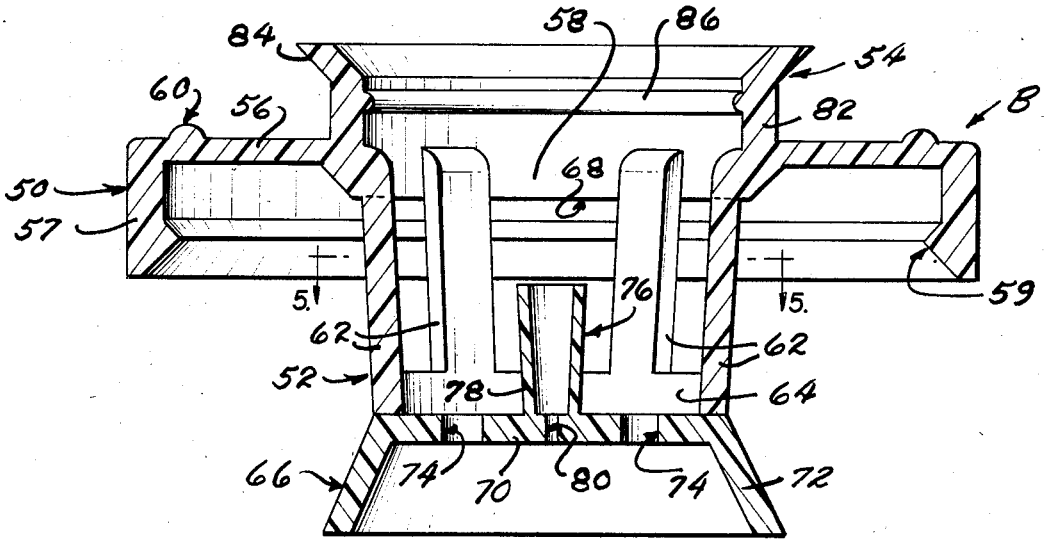
FIG. 3 is a vertical sectional view of the fitment of our improved pourout fitment/closure.

In the drawings, wherein similar reference characters designate corresponding parts throughout the several views, the letter A may generally designate the closure and the letter B the fitment of our improved pourout fitment/closure, as provided for attachment to such as a container C.

Container C may comprise any conventional container for liquids. As within a primary purpose in the making of this invention, the same may comprise a bottle 19 including a neck 20 providing a discharge opening 21 through which liquid may be dispensed from bottle 19. Neck 20 may have external threads 23 in providing means for attachment of closure A thereto and an external annular groove 24 adjacent the rim thereof in providing means for retaining fitment B thereon.

Closure A may have a body portion comprised of a top portion 30 and a depending skirt 31. As shown, top portion 30 may be of a disk-like configuration and skirt 31 may be of a tubular configuration perimetrically depending from top portion 30 and defining an inner surface 34 of top portion 30 which is confrontable to and extends across discharge opening 21 of neck 20.

The inner diameter of tubular skirt 31 may be provided with retaining means, threads 36 in the form of invention as shown, for removable attachment of closure A to neck 20 of container C by engagement of threads 36 of closure A with threads 23 of neck 20.

Closure A is preferably provided with radially spaced circumferential legs 38 and 39 which depend from inner surface 34 of top portion 30. The lowermost end of outer leg 38 is preferably provided with a concave groove 40, for cooperative engagement with fitment B, as will be subsequently described. Inner leg 29 is preferably provided with a circumferential recess 42, also for cooperative engagement with fitment B, as will be subsequently described.

Inner surface 34 of top portion 30 may be provided with a recess 45 extending circumferentially of inner leg 39, for cooperative engagement with fitment B, as will be subsequently described.

Fitment B preferably includes a flanged disk-like body portion 50 providing means for attachment of fitment B to neck 20; a generally cylindrical hub portion 52, depending from flanged portion 50 to within discharge opening 21 of neck 20, providing means for regulating the rate of flow and dispersion of liquid as poured from container 19; and a tubular member 54 comprising a pouring spout, intercommunicating with hub 52 and for receiving liquid therefrom as poured from container 19.

Flanged portion 50 preferably comprises a disk-like member 56 having a circumferentially depending skirt 57 and an inner generally tubular wall 58 defining a flowway for liquid therethrough. The inner diameter of skirt 57 is preferably provided with an annular tooth 59 which is adapted to interfit within annular groove 24 of neck 20 for attachment of fitment B to neck 20.

The upper surface of disk-like member 56 may be provided with an annular convex bead 60, positioned for cooperative interengagement within concave groove 40 of closure A. As shown in FIG. 6, interengagement of bead 60 within groove 40 provides a sealing interconnection of closure A with fitment B. Bead 60 and groove 40 are preferably approximately circumferentially positioned to overlie the rim of neck 20. As so positioned, tightened interengagement of bead 60 within groove 40 acts to press the lower surface of member 56 into sealing engagement with the rim of neck 20. Bead 60 is preferably of slightly less radial transverse cross section than groove 40. Such differential is provided to allow for variances in manufacturing tolerances present in the closure, fitment and the container to which the same are attached.

Hub portion 52 preferably includes a plurality of pillars 62 interconnected at one end thereof to and axially depending in a spaced apart relation from wall 58 of flanged portion 50. The other end of pillars 62 are interconnected to tubular member 64, to the lowermost end of which is interconnected baffle 66.

The lowermost reach of wall 58, opposed sides of adjacent pillars 62 and the upper reach of tubular member 64 define a plurality of spaced circumferential windows 68 through which liquid may be received in dispensing of the same from container 19. The size of windows 68 will be a determinative factor as to the rate of flow in dispensing liquid therethrough.

In essence, tubular member 64 defines a gate, the height of which above baffle 66 is designed to factor the size of windows 68 and thereby the rate of flow therethrough.

Baffle 66 is preferably of an inverted, disk-like configuration, including a disk-like bottom wall 70, to one side of which is circumferentially interconnected the lower reach of tubular member 64, and having a side wall 72 divergently extending circumferentially from the other side thereof.

Baffle 66 is provided to interrupt and disperse liquid being dispensed from container 19. By having to pass around baffle 66, liquid flow is broken into a circular pattern and, by having to flow past baffle 66, prior to entering through windows 68, the liquid has less tendency to spurt as it is initially poured from container 19.

Vent holes 74 may be provided through wall 70 of baffle 66. Such vent holes are to permit air intake into container 19 as liquid is dispensed therefrom. As so situated, vent holes 74 act to reduce interuptions to liquid flow which sometimes occurs on the intake of air to within container 19 as brought about by the partial vacuum created therewithin when liquid is dispensed therefrom. In other words, vent holes 74 aid in providing smooth liquid flow.

A preferably conical post 76 may be mounted centrally on wall 70, extending in a flared relation therefrom to within the flowway as defined by pillars 62. Post 76 may be solid or, as shown, have a side wall 78, in which case a drain hole 80 may be provided through wall 70 so that liquid will not remain entrapped therewithin when pouring is completed and container 19 returned to an upright position. Also, in a minor way, drain hole 80 may serve as a third vent hole, assisting vent holes 74 for air intake into container 19 as liquid is dispensed therefrom.

Center post 76 provides a further means to reduce spurting of liquid as it is dispensed.

Although center post 76 might, for instance, be cylindrical, or of other orbicular configuration, rather than conical, it has been found that a cone shape thereof acts to better disperse the liquid pour in a circular pattern as the same passes through windows 68 and through the fitment. Center post 76 provides means for dispensing liquid flow through the fitment into a generally circular flow as the contents pass through windows 68. Center post 76 is thus of a height greater than that of the gate provided by tubular member 64, but should not exceed the height of windows 68, preferably extending to not more than sixty per cent of the height of windows 68. Also, the maximum diameter of center post 76 is preferably not more than fifty per cent of the width of windows 68.

Tubular pouring spout 54 is preferably defined by a tubular side wall 82, which may be concomitant with tubular wall 58 of the flanged portion 50, and having a fluid pouring lip 84. An annular bead 86 may be provided about the inner diameter of wall 82.

As shown in FIG. 6, the rim of flared lip 84 may be configured to be received within recess 45 of closure A, providing a sealing of closure A over the discharge mouth of fitment A.

Annular bead 86 serves several purposes, as follows:

It is preferable that a fitment/closure be unitarily applied to a container. As shown in FIG. 6, annular bead 86 has a snap fit within recess 42 of closure A, providing retaining means whereby fitment B may be releasably attached to closure A so that the fitment/closure can be applied to container 19 as one unit in a single manufacturing step.

Annular bead 86 also acts as a drip ring, to prevent dripping of liquid when the pouring action has been completed.

Various changes may be made to the form of the invention as herein shown and described without departing from the spirit of the invention or the scope of the following claims.

We claim:

1. A pourout fitment/closure for use on a container including a tubular neck defining a pourout opening for the container and configured for attachment of said fitment/closure thereto; said fitment/closure including retaining means for releasable interconnection of said fitment to said closure so that said fitment/closure can be applied as a single unit to the tubular neck of the container, said retaining means being operable to release said closure from said fitment when said closure is removed from the tubular neck of the container; said fitment including a flanged disk-like body portion having means for attachment of said fitment to the tubular neck of the container and over the pourout opening thereof, a generally cylindrical hub portion depending from said flanged disk-like body portion to within the pourout opening of the tubular neck of the container and providing a flowway for regulating the rate of flow and dispersion of liquid as poured from the container, and a tubular portion comprising a pouring spout intercommunicating with said flowway of said hub portion for receiving liquid therefrom as poured from the container; said hub portion having a plurality of spaced circumferential windows opening into said flowway thereof for regulating the rate of flow of liquid into said flowway, a bottom wall for diverting liquid flow thereabout and through said windows, and a center post of orbicular cross section mounted substantially centrally on said bottom wall and extending to within said flowway in a spaced apart relation to and confronting said windows for dispersing the liquid pour as it passes through said windows and through said flowway; and said closure includes a top portion having a depending skirt provided with means for removable attachment of said closure to the tubular neck of the container and over the pourout opening thereof, and means cooperatively interacting with said fitment for providing a substantially liquid tight seal over the pourout opening of the container when said closure is attached thereto.

2. A pourout fitment/closure as specified in claim 1 and wherein said center post extends in confronting relation to said windows to a height less than the height of said windows.

3. A pourout fitment/closure as specified in claim 2 and wherein the height of said center post is not more than sixty percent of the height of said windows.

4. A pourout fitment/closure as specified in claim 1 and wherein the maximum diametrical cross section of said center post is less than the width of said windows.

5. A pourout fitment/closure as specified in claim 4 and wherein the maximum diametrical cross section of said center post is not more than fifty percent of the width of said windows.

6. A pourout fitment/closure as specified in claim 1 wherein said center post extends in confronting relation to said windows to a height less than the height of said windows and wherein the maximum diametrical cross section of said center post is less than the width of said windows.

7. A pourout fitment/closure as specified in claim 6 and wherein the height of said center post is not more than sixty percent of the height of said windows and wherein the maximum diametrical cross section of said center post is not more than fifty percent of the width of said windows.

8. A pourout fitment/closure as specified in either of claims 1, 2, 3, 4, 5, 6, or 7, and wherein said center post is conical, having a side wall divergent from said bottom wall.

9. A pourout fitment/closure as specified in claim 8 wherein said center post is hollow and said bottom wall is provided with a drain hole therefor.

10. A pourout fitment/closure as specified in either of claims 1, 2, 3, 4, 5, 6, or 7, and wherein said flanged disk-like body portion of said fitment includes an annular convex bead and said top portion of said closure includes a circumferential outer leg depending from the inner surface thereof and having a concave groove extending about the lowermost end thereof for cooperative interengagement therewithin of said convex bead of said fitment.

11. A pourout fitment/closure as specified in claim 10 and wherein said center post is conical, having a side wall divergent from said bottom wall.

12. A pourout fitment/closure as specified in claim 11 wherein said center post is hollow and said bottom wall is provided with a drain hole therefor.

13. A pourout fitment/closure as specified in either of claims 1, 2, 3, 4, 5, 6, or 7, and wherein said hub portion includes a tubular member mounted on said bottom wall thereof and a plurality of pillars interconnected at the upper end thereof to said flanged disk-like body portion thereof and at the lower end thereof to said tubular member, said flanged disk-like body portion defining the top of said windows, said pillars the sides thereof, and said tubular member the bottom thereof, and wherein said tubular member comprises a gate for determining the basic rate of flow through said windows.

14. A pourout fitment/closure as specified in claim 13, and wherein said center post is conical, having a side wall divergent from said bottom wall.

15. A pourout fitment/closure as specified in claim 14 wherein said center post is hollow and said bottom wall is provided with a drain hole therefor.

16. A pourout fitment/closure as specified in claim 13 and wherein said flanged disk-like body portion of said fitment includes an annular convex bead and said top portion of said closure includes a circumferential leg depending from the inner surface thereof and having a concave groove extending about the lowermost end thereof for cooperative interengagemcnt therewithin of said convex bead of said fitment.

17. A pourout fitment/closure as specified in claim 16, and wherein said center post is conical, having a side wall divergent from said bottom wall.

18. A pourout fitment/closure as specified in claim 17 wherein said center post is hollow and said bottom wall is provided with a drain hole therefor.

19. A pourout fitment/closure as specified in either of claims 1, 2, 3, 4, 5, 6, or 7 and wherein said bottom wall of said hub portion includes a depending side wall divergently extending circumferentially therebelow and providing a baffle for interrupting and dispersing liquid flow thereabout on its passage to said windows.

20. A pourout fitment/closure as specified in claim 19, and wherein said center post is conical, having a side wall divergent from said bottom wall.

21. A pourout fitment/closure as specified in claim 20 wherein said center post is hollow and said bottom wall is provided with a drain hole therefor.

22. A pourout fitment/closure as specified in claim 19, and wherein said flanged disk-like body portion of said fitment includes an annular convex bead and said top portion of said closure includes a circumferential outer leg depending from the inner surface thereof and having a concave groove extendant about the lowermost end thereof for cooperative interengagement therewithin of said convex bead of said fitment.

23. A pourout fitment/closure as specified in claim 22, and wherein said center post is conical, having a side wall divergent from said bottom wall.

24. A pourout fitment/closure as specified in claim 23 wherein said center post is hollow and said bottom wall is provided with a drain hole therefor.

25. A pourout fitment/closure as specified in claim 19, and wherein said hub portion includes a tubular member mounted on said bottom wall thereof and a plurality of pillars interconnected at the upper end thereof to said flanged disk-like body portion thereof and at the lower end thereof to said tubular member, said flanged disk-like body portion defining the top of said windows, said pillars the sides thereof, and said tubular member the bottom thereof, and wherein said tubular member comprises a gate for determining the basic rate of flow through said windows.

26. A pourout fitment/closure as specified in claim 25, and wherein said center post is conical, having a side wall divergent from said bottom wall.

27. A pourout fitment/closure as specified in claim 26 wherein said center post is hollow and said bottom wall is provided with a drain hole therefor.

28. A pourout fitment/closure as specified in claim 25, and wherein said flanged disk-like body portion of said fitment includes an annular convex bead and said top portion of said closure includes a circumferential outer leg depending from the inner surface thereof and having a concave groove extendant about the lowermost end thereof for cooperative interengagement therewithin of said convex bead of said fitment.

29. A pourout fitment/closure as specified in claim 28, and wherein said center post is conical, having a side wall divergent from said bottom wall.

30. A pourout fitment/closure as specified in claim 29 wherein said center post is hollow and said bottom wall is provided with a drain hole therefor.

31. A pourout fitment/closure as specified in either of claims 1, 2, 3, 4, 5, 6, or 7, and wherein said bottom wall of said hub portion is provided with at least two vent holes symmetrically spaced apart to sides of said center post for permitting ingress of air to within the container as liquid is poured therefrom and thereby smoothing out the flow of liquid being dispensed.

32. A pourout fitment/closure as specified in claim 31, and wherein said bottom wall of said hub portion includes a depending side wall divergently extending circumferentially therebelow and providing a baffle for interrupting and dispersing liquid flow thereabout on its passage to said windows.

33. A pourout fitment/closure as specified in claim 32, and wherein said center post is conical, having a side wall divergent from said bottom wall.

34. A pourout fitment/closure as specified in claim 33 wherein said center post is hollow and said bottom wall is provided with a drain hole therefor.

35. A pourout fitment/closure as specified in claim 32, and wherein said flanged disk-like body portion of said fitment includes an annular convex bead and said top portion of said closure includes a circumferential outer leg depending from the inner surface thereof and having a concave groove extending about the lowermost end thereof for cooperative interengagement therewithin of said convex bead of said fitment.

36. A pourout fitment/closure as specified in claim 35, and wherein said center post is conical, having a side wall divergent from said bottom wall.

37. A pourout fitment/closure as specified in claim 36 wherein said center post is hollow and said bottom wall is provided with a drain hole therefor.

38. A pourout fitment/closure as specified in claim 32, and wherein said hub portion includes a tubular member mounted on said bottom wall thereof and a plurality of pillars interconnected at the upper end thereof to said flanged disk-like body portion thereof and at the lower end thereof to said tubular member, said flanged disk-like body portion defining the top of said windows, said pillars the sides thereof, and said tubular member the bottom thereof, and wherein said tubular member comprises a gate for determining the basic rate of flow through said windows.

39. A pourout fitment/closure as specified in claim 38, and wherein said center post is conical, having a side wall divergent from said bottom wall.

40. A pourout fitment/closure as specified in claim 39 wherein said center post is hollow and said bottom wall is provided with a drain hole therefor.

41. A pourout fitment/closure as specified in claim 38, and wherein said flanged disk-like body portion of said fitment includes an annular convex bead and said top portion of said closure includes a circumferential outer leg depending from the inner surface thereof and having a concave groove extending about the lowermost end thereof for cooperative interengagement therewithin of said convex bead of said fitment.

42. A pourout fitment/closure as specified in claim 41, and wherein said center post is conical, having a side wall divergent from said bottom wall.

43. A pourout fitment/closure as specified in claim 42, wherein said center post is hollow and said bottom wall is provided with a drain hole therefor.

44. A pourout fitment/closure as specified in either of claims 1, 2, 3, 4, 5, 6, or 7, and wherein said tubular portion of said hub portion includes an annular bead about the inner diameter thereof for providing a drip ring to inhibit dripping of liquid when the pouring action has been completed and a divergently flared pouring lip; and said top portion of said closure including a circumferential inner leg depending from the inner surface thereof, said inner leg having a circumferential recess for interfitting cooperative engagement of said annular bead of said fitment therewithin and providing said retaining means for releasable interconnection of said fitment to said closure.

45. A pourout fitment/closure as specified in claim 44, and wherein said bottom wall of said hub portion is provided with at least two vent holes symmetrically spaced apart to sides of said center post for permitting ingress of air to within the container as liquid is poured therefrom and thereby smoothing out the flow of liquid being dispensed.

46. A pourout fitment/closure as specified in claim 45, and wherein said bottom wall of said hub portion includes a depending side wall divergently extending circumferentially therebelow and providing a baffle for interrupting and dispersing liquid flow thereabout on its passage to said windows.

47. A pourout fitment/closure as specified in claim 46, and wherein said center post is conical, having a side wall divergent from said bottom wall.

48. A pourout fitment/closure as specified in claim 47 wherein said center post is hollow and said bottom wall is provided with a drain hole therefor.

49. A pourout fitment/closure as specified in claim 46, and wherein said flanged disk-like body portion of said fitment includes an annular convex bead and said top portion of said closure includes a circumferential outer leg depending from the inner surface thereof and having a concave groove extending about the lowermost end thereof for cooperative interengagement therewithin of said convex bead of said fitment.

50. A pourout fitment/closure as specified in claim 49, and wherein said center post is conical, having a side wall divergent from said bottom wall.

51. A pourout fitment/closure as specified in claim 50 wherein said center post is hollow and said bottom wall is provided with a drain hole therefor.

52. A pourout fitment/closure as specified in claim 46, and wherein said hub portion includes a tubular member mounted on said bottom wall thereof and a plurality of pillars interconnected at the upper end thereof to said flanged disk-like body portion thereof and at the lower end thereof to said tubular member, said flanged disk-like body portion defining the top of said windows, said pillars the sides thereof, and said tubular member the bottom thereof, and wherein said tubular member comprises a gate for determining the basic rate of flow through said windows.

53. A pourout fitment/closure as specified in claim 52, and wherein said center post is conical, having a side wall divergent from said bottom wall.

54. A pourout fitment/closure as specified in claim 53 wherein said center post is hollow and said bottom wall is provided with a drain hole therefor.

55. A pourout fitment/closure as specified in claim 52, and wherein said flanged disk-like body portion of said fitment includes an annular convex bead and said top portion of said closure includes a circumferential outer leg depending from the inner surface thereof and having a concave groove extending about the lowermost end thereof for cooperative interengagement therewithin of said convex bead of said fitment.

56. A pourout fitment/closure as specified in claim 55, and wherein said center post is conical, having a side wall divergent from said bottom wall.

57. A pourout fitment/closure as specified in claim 56 wherein said center post is hollow and said bottom wall is provided with a drain hole therefor.

* * * * *